US010260514B2

(12) United States Patent
Kim

(10) Patent No.: US 10,260,514 B2
(45) Date of Patent: Apr. 16, 2019

(54) SYSTEM AND METHOD OF CONTROLLING COMPRESSOR

(71) Applicant: HANWHA AEROSPACE CO., LTD., Changwon-si (KR)

(72) Inventor: Do Hyung Kim, Changwon-si (KR)

(73) Assignees: HANWHA POWER SYSTEMS CO., LTD, Changwon-si (KR); HANWHA AEROSPACE CO., LTD, Changwon-si (KR)

( * ) Notice: Subject to any disclaimer, the term of this patent is extended or adjusted under 35 U.S.C. 154(b) by 219 days.

(21) Appl. No.: 15/451,697

(22) Filed: Mar. 7, 2017

(65) Prior Publication Data

US 2017/0260988 A1 Sep. 14, 2017

(30) Foreign Application Priority Data

Mar. 11, 2016 (KR) ..... 10-2016-0029684

(51) Int. Cl.
*F04D 27/02* (2006.01)

(52) U.S. Cl.
CPC ..... *F04D 27/0246* (2013.01); *F04D 27/02* (2013.01); *F04D 27/0215* (2013.01); *F04D 27/0223* (2013.01); *F05D 2270/101* (2013.01); *F05D 2270/44* (2013.01)

(58) Field of Classification Search
CPC .. F04D 27/02; F04D 27/0246; F04D 27/0215; F04D 27/0223; F04D 27/0253; F04D 27/001; F04D 27/0207; F04D 17/10; F04D 19/00; F02C 19/18; F02C 7/32; F05D 2270/10; F05D 2270/101; F05D 2270/3013; F05D 2270/44
See application file for complete search history.

(56) References Cited

U.S. PATENT DOCUMENTS 5,632,154 A 5/1997 Sibik et al.
5,798,941 A * 8/1998 McLeister ..... G05B 11/42 415/1
2007/0137199 A1* 6/2007 Magner ..... F02B 37/127 60/602

(Continued)

FOREIGN PATENT DOCUMENTS

JP 6-146930 A 5/1994
JP 11-501114 A 1/1999

(Continued)

*Primary Examiner* — George C Jin
(74) *Attorney, Agent, or Firm* — Sughrue Mion, PLLC

(57) ABSTRACT

A compressor control system includes a compressor compressing a fluid, an anti-surge valve preventing backflow in the compressor, the anti-surge valve being arranged on a line connecting an inlet and an outlet of the compressor and operated by a first signal, an inlet guide vane controlling an opening area of the inlet, the inlet guide vane being arranged at the inlet and operated by a second signal, and a controller connected to the anti-surge valve and the inlet guide vane and generating the first signal to control the anti-surge valve, a vane control signal to control the inlet guide vane, a pressure compensation signal to control the inlet guide vane to compensate for a change in pressure at the outlet of the compressor according to the first signal, and the second signal by combining the pressure compensation signal with the vane control signal.

6 Claims, 9 Drawing Sheets

(56) References Cited

U.S. PATENT DOCUMENTS

| | | | | |
|---|---|---|---|---|
| 2007/0193249 | A1 | 8/2007 | Takashima et al. | |
| 2012/0247115 | A1* | 10/2012 | Sasahara | F02C 6/18 60/772 |
| 2015/0308442 | A1* | 10/2015 | Giove | F04D 27/0215 415/1 |
| 2016/0341131 | A1* | 11/2016 | Nakagawa | F02C 9/46 |
| 2018/0010611 | A1* | 1/2018 | Bae | F04D 25/06 |

FOREIGN PATENT DOCUMENTS

| | | | |
|---|---|---|---|
| JP | 2007-211705 | A | 8/2007 |
| JP | 5673738 | B2 | 2/2015 |
| KR | 10-2012-0096748 | A | 8/2012 |

* cited by examiner

SYSTEM AND METHOD OF CONTROLLING COMPRESSOR

CROSS-REFERENCE TO RELATED APPLICATION

This application claims priority from Korean Patent Application No. 10-2016-0029684, filed on Mar. 11, 2016, in the Korean Intellectual Property Office, the disclosure of which is incorporated herein in its entirety by reference.

BACKGROUND

1. Field

One or more exemplary embodiments relate to a system and method of controlling a compressor, and more particularly, to a system and method of controlling a compressor, by which influences of an inlet guide vane and an anti-surge valve on each other are reduced and a compressor may stably operate.

2. Description of the Related Art

A fluid control system of controlling liquid or fluid in a gaseous state uses a compressor for compressing a fluid. A compressor is designed to operate with a high efficiency with respect to ejection pressure and flow rate in a range as wide as possible. Not only the efficiency of a compressor, but also an operating range of a compressor may function as important performance variables of the fluid control system.

For example, in a turbo compressor, when the turbo compressor fails to produce a pressure greater than a pressure resistance of an entire fluid control system, a backflow phenomenon of a cyclic flow in the compressor is generated, which is referred to as "surge".

When a surge phenomenon occurs, a pressure and a flow rate are perturbed by the cyclic backflow of flow. The perturbation generates mechanical vibration and damages accessory elements such as a bearing or an impeller. As such, the surge phenomenon may not only deteriorate the performance of a compressor but also shorten the lifespan of a compressor. Accordingly, in the operation of a compressor, a function of preventing a surge phenomenon (anti-surge) is important in a compressor control system for controlling a turbo compressor. When an anti-surge valve (ASV) is used to implement the anti-surge function, the generation of a surge phenomenon may be prevented by reducing the resistance of a fluid system.

Also, in the compressor control system, in addition to the anti-surge valve, an inlet guide vane (IGV) is installed at an inlet of a compressor to control the operating range of the compressor.

FIG. 1 is a performance map of a general compressor. In FIG. 1, the vertical axis denotes pressure and the horizontal axis denotes a flow rate. Surge control is performed by setting a surge control line with a margin of about 10% from a surge line and controlling an IGV or ASV when an operating point reaches the surge control line, so that the operating point is moved away from the surge line.

Since the ASV does not operate until the operating point reaches the surge line, a coupling phenomenon is not generated. However, when the operating point enters a surge area in which the surge phenomenon may occur, both the IGV and the ASV are operated. Since both the IGV and the ASV change the pressure and flow rate of a compressor, the coupling phenomenon may occur as the IGV and the ASV are operated together.

FIG. 2 is a graph for explaining a coupling phenomenon occurring in the IGV and the ASV of the compressor of FIG. 1.

For example, assuming that a compressor is controlled at an operating point A in FIG. 2, a direction to control the IGV and a direction to control the ASV may interfere with each other. In other words, to decrease pressure, the IGV is controlled in a direction to decrease (shut) a degree of opening (opening range) of the IGV. When the IGV is controlled to decrease the opening range, a flow rate and pressure are decreased and thus the control point of IGV in FIG. 2 is moved in a direction toward the lower left corner.

However, to increase the flow rate, the ASV is controlled in a direction to increase an opening range of the ASV, thereby preventing a surge phenomenon. When the ASV is controlled in a direction to open the ASV, the flow rate increases and the pressure decreases and the control point of ASV in FIG. 2 is moved in a direction toward the lower right corner. As such, since interference occurs between the control operations of the IGV and the ASV, a pressure hunting phenomenon occurs so that an unstable flow is repeated and thus the operation of a compressor becomes unstable.

The coupling phenomenon is generated because although the ejection pressure of a compressor is controlled by the operation of IGV, the flow rate is affected by the operation of IGV, and although the control using the flow rate of a compressor is possible by the operation of ASV, the pressure is affected by the operation of ASV. Accordingly, in the surge area, two valves of the IGV and the ASV interfere with mutual operations so that it is difficult to control the overall system of a compressor.

To avoid the interference problem between the control operations of the ASV and the IGV as described above, a method of reducing interference in the surge area is used in which a control gain of a proportional-integral-derivative (PID) controller for the control of the IGV and the ASV is set to be different from each other and the control gain of any one of the IGV and the ASV is set to be dominant. However, the gain control method has a limit in that tuning of a controller is complicated and difficult, and the coupling phenomenon is not completely addressed.

For example, when an IGV gain is set to be relatively greater than an ASV gain, although the pressure is stabilized, as the operating point enters the surge area, the surge phenomenon is highly likely to occur or it is difficult to deal with a sudden change in the consumption flow rate at the rear end of a compressor.

Also, when the ASV gain is set to be relatively greater than the IGV gain, as the ASV is quickly opened when the operating point enters the surge area, the range of pressure drop increases. In this case, although a sudden change in the consumption flow rate may be coped with, as the range of pressure drop increases, the operation of a compressor may be unstable.

SUMMARY

One or more exemplary embodiments of the present disclosure comprise a system and method of controlling a compressor, by which the compressor stably operates.

One or more exemplary embodiments comprise a system and method of controlling a compressor, by which influences of the control of an inlet guide vane and the control of an anti-surge valve on each other are reduced and the operation of a compressor may be controlled.

Additional aspects will be set forth in part in the description which follows and, in part, will be apparent from the description, or may be learned by practice of the exemplary embodiments presented herein.

According to one or more exemplary embodiments, a compressor control system comprises a compressor compressing a fluid, an anti-surge valve preventing backflow in the compressor, the anti-surge valve being arranged on a line connecting an inlet and an outlet of the compressor and operated by a first signal, an inlet guide vane controlling an opening area of the inlet, the inlet guide vane being arranged at the inlet and operated by a second signal, and a controller connected to the anti-surge valve and the inlet guide vane and generating the first signal to control the anti-surge valve, a vane control signal to control the inlet guide vane, a pressure compensation signal to control the inlet guide vane to compensate for a change in pressure at the outlet of the compressor according to the first signal, and the second signal by combining the pressure compensation signal with the vane control signal.

A size of an absolute value of the second signal may be smaller than a size of an absolute value of the vane control signal.

According to one or more exemplary embodiments, a method of controlling a compressor comprises generating a first signal to operate an anti-surge valve that is arranged on a line connecting an inlet and an outlet of a compressor for compressing fluid and prevents backflow in the compressor, generating a pressure compensation signal to control an inlet guide vane to compensate for a change in pressure at the outlet of the compressor according to the first signal, generating a vane control signal to control the inlet guide vane that is arranged at the inlet of the compressor and controls an opening area of the inlet, and generating a second signal to operate the inlet guide vane by combining the pressure compensation signal with the vane control signal.

In the generating of the second signal, the pressure compensation signal may be combined with the vane control signal and a size of an absolute value of the second signal may be smaller than a size of an absolute value of the vane control signal.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
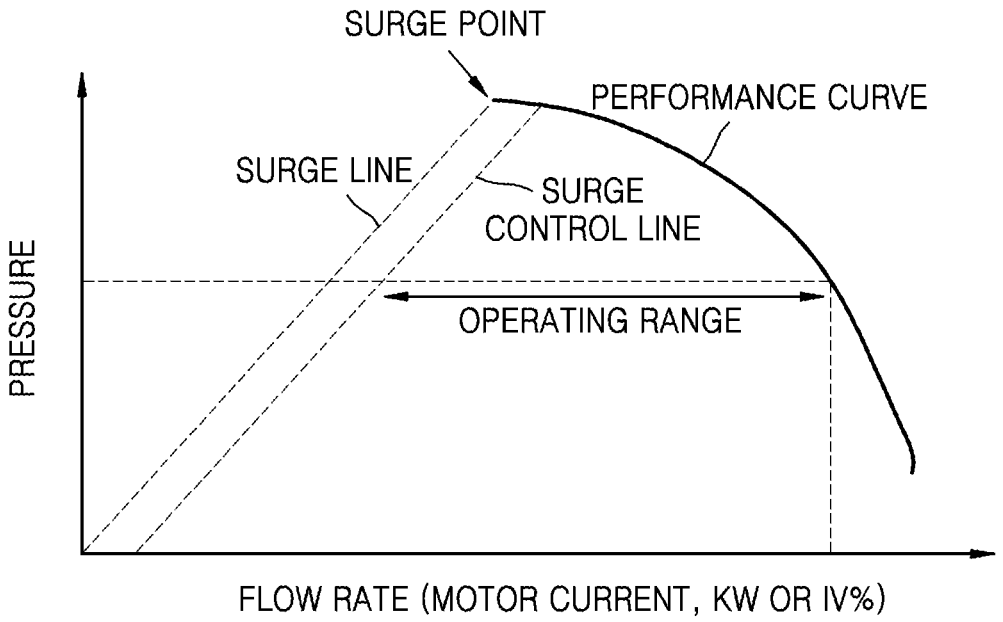
FIG. 1 is a performance map of a general compressor.
Figure 2:
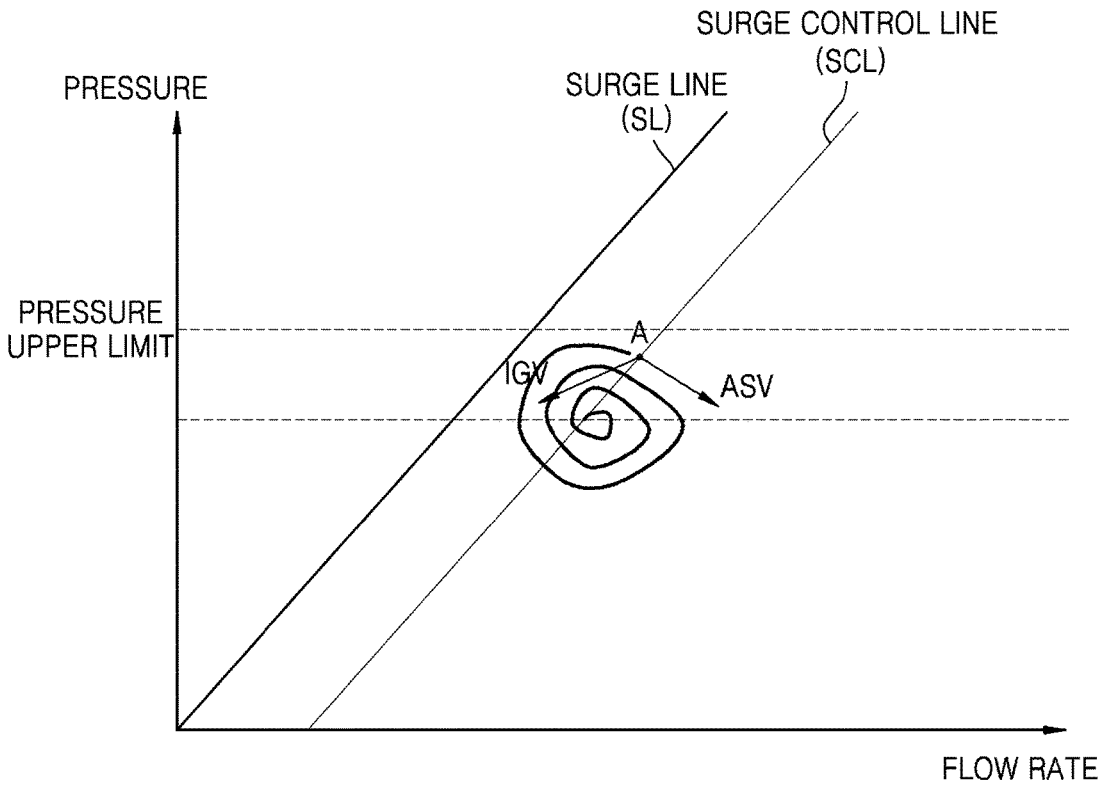
FIG. 2 is a graph for explaining a coupling phenomenon occurring in an inlet guide vane (IGV) and an anti-surge valve (ASV) of the compressor of FIG. 1.

Reference will now be made in detail to exemplary embodiments, examples of which are illustrated in the accompanying drawings, wherein like reference numerals refer to like elements throughout and redundant descriptions are omitted. In this regard, the present exemplary embodiments may have different forms and should not be construed as being limited to the descriptions set forth herein. Accordingly, the exemplary embodiments are merely described below, by referring to the figures, to explain aspects of the present disclosure.

As used herein, the term "and/or" includes any and all combinations of one or more of the associated listed items. Expressions such as "at least one of," when preceding a list of elements, modify the entire list of elements and do not modify the individual elements of the list.

While such terms as "first," "second," etc., may be used to describe various components, such components must not be limited to the above terms. The above terms are used only to distinguish one component from another.

As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

It will be understood that when a layer, region, or component is referred to as being "formed on" another layer, region, or component, it can be directly or indirectly formed on the other layer, region, or component. That is, for example, intervening layers, regions, or components may be present.

Sizes of components in the drawings may be exaggerated for convenience of explanation. In other words, since sizes and thicknesses of components in the drawings are arbitrarily illustrated for convenience of explanation, the following embodiments are not limited thereto.

It should be understood that a degree of opening (opening range) of the anti-surge valve (AGV), and a degree of opening (opening area) of the inlet guide vane (IGV) may also be expressed as a degree of closure, or any other suitable measure as would be understood by one skilled in the art, for example % close or % open.

When a certain embodiment may be implemented differently, a specific process order may be performed differently from the described order. For example, two consecutively described processes may be performed substantially at the same time or performed in an order opposite to the described order.

Figure 3:
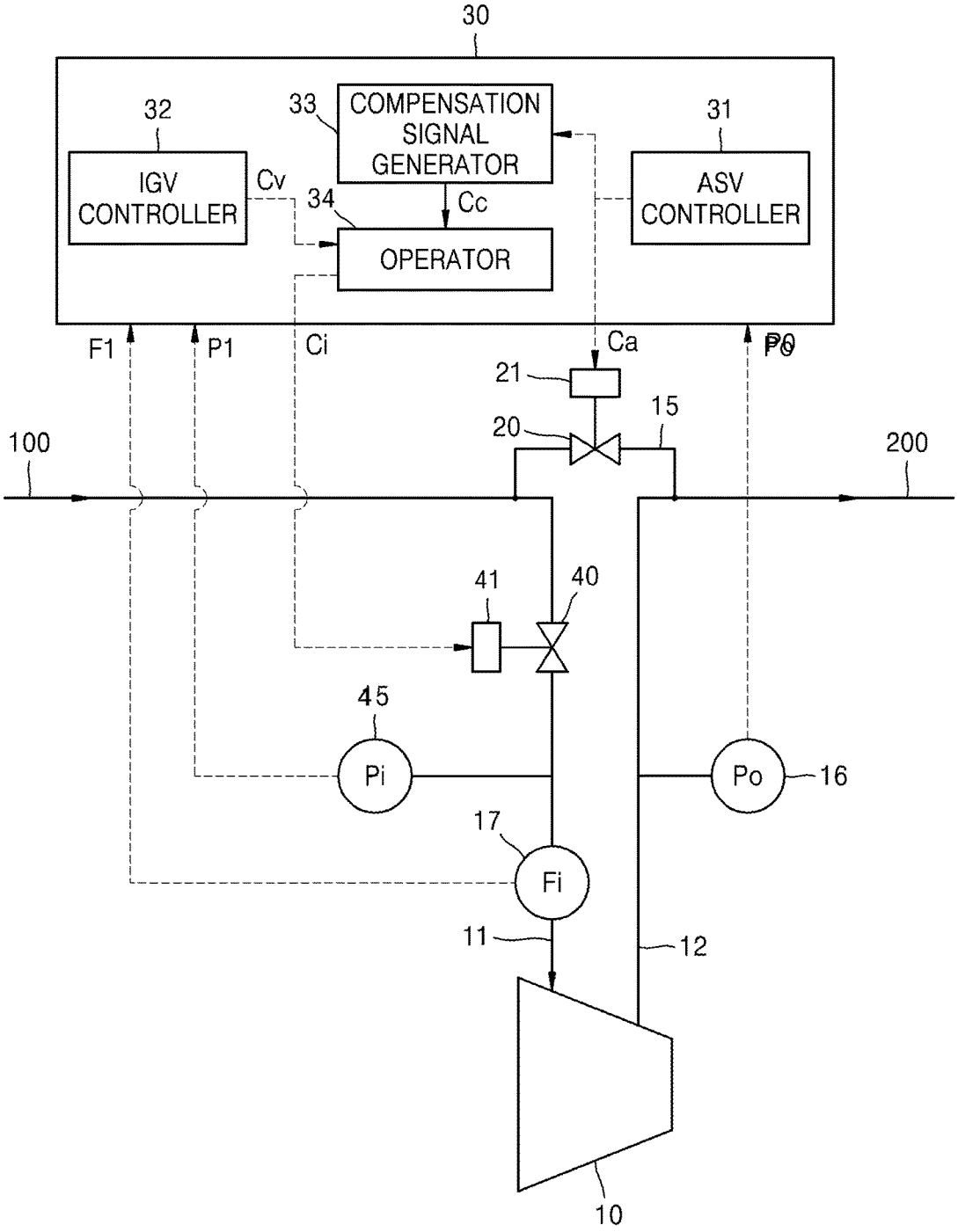
FIG. 3 is a schematic block diagram of a structure of a compressor control system according to an exemplary embodiment.

FIG. 3 is a schematic block diagram of a structure of a compressor control system according to an exemplary embodiment.

Referring to FIG. 3, a compressor control system according to a first embodiment may include a compressor 10, an anti-surge valve (ASV) 20 arranged on a bypass line 15 connecting an inlet 11 to an outlet 12 of the compressor 10, an inlet guide vane (IGV) 40 arranged at the inlet 11 of the compressor 10, and a controller 30 controlling the ASV 20 and the IGV 40.

The compressor 10 takes in fluid having a certain inlet condition and increases pressure of the fluid and then supplies compressed fluid to a fluid system or equipment in operation. A compressor of a variety of types such as a centrifugal type or an axial flow type may be used as the compressor 10.

In general, since a supply pipe 100 is connected to the inlet 11 of the compressor 10 and a discharge pipe 200 is connected to the outlet 12 of the compressor 10, the compressor 10 takes in the fluid supplied through the supply pipe 100 and discharges the compressed fluid through the discharge pipe 200.

Although in the first embodiment a gas is used as the fluid that passes through various fluid mechanical elements including the compressor 10, the present disclosure is not limited to this type of fluid and, for example, liquid may be used as the fluid.

The bypass line 15 connects the outlet 12 of the compressor 10 to the inlet 11 of the compressor 10 without connecting the compressor 10. In other words, when the bypass line 15 is open, the fluid output from the compressor 10 flows into the inlet 11 of the compressor 10 and a difference between a pressure at the inlet's side of the compressor 10 and pressure at the outlet's side of the compressor 10 decreases while a flow rate of fluid flowing into the compressor 10 increases.

Accordingly, the ASV 20 may perform a function of preventing backflow in the compressor 10 by controlling opening/shutting of the bypass line 15. The ASV 20 may be implemented by, for example, an electronic valve such as a solenoid valve that is electronically controllable.

The ASV 20 is connected to an ASV driver 21 that is operated by a first signal Ca applied by an ASV controller 31 of the controller 30. Accordingly, the ASV 20 performs a function of preventing backflow in the compressor 10 by being operated by the first signal Ca.

The IGV 40 is arranged at the inlet 11 of the compressor 10 and performs a function of controlling an opening area of the inlet 11. The IGV 40 may include a plurality of vanes and control the opening area of the inlet 11 by controlling angles of the vanes. Also, the IGV 40 may be implemented by, for example, an electronic valve such as a solenoid valve that is electronically controllable.

The IGV 40 is connected to an IGV driver 41 that is operated by a second signal Ci applied by the controller 30. Accordingly, the IGV 40 may control the opening area of the inlet 11 of the compressor 10 by being operated by the second signal Ci applied by the controller 30.

The controller 30 is electrically connected to the ASV 20 and the IGV 40. The controller 30 may include the ASV controller 31 generating the first signal Ca for controlling the ASV 20, an IGV controller 32 generating a vane control signal Cv for controlling the IGV 40, a compensation signal generator 33 generating a pressure compensation signal Cc for compensating for a change in the pressure at the outlet 12 of the compressor 10 by the first signal Ca, and an operator 34 generating the second signal Ci by combining the pressure compensation signal Cc of the compensation signal generator 33 with the vane control signal Cv.

The controller 30 may be implemented in the form of, for example, a circuit board mounted in a computer for controlling a compressor control system, a computer chip mounted on the circuit board, or software included in a computer chip or a computer for control.

A flow meter 17 (Fi) that measures a flow rate of fluid at the side of the inlet 11 of the compressor 10 and transmits a flow rate signal F1 to the controller 30, and a first manometer 45 (Pi) that measures pressure of the fluid at the side of the inlet 11 of the compressor 10 and transmits a pressure signal P1 to the controller 30, may each be connected to the inlet 11 of the compressor 10.

Also, a second manometer 16 (Po) that measures pressure of the fluid at the side of the outlet 12 of the compressor 10 and transmits a pressure signal P0 to the controller 30 may be connected to the outlet 12 of the compressor 10.

Figure 4:
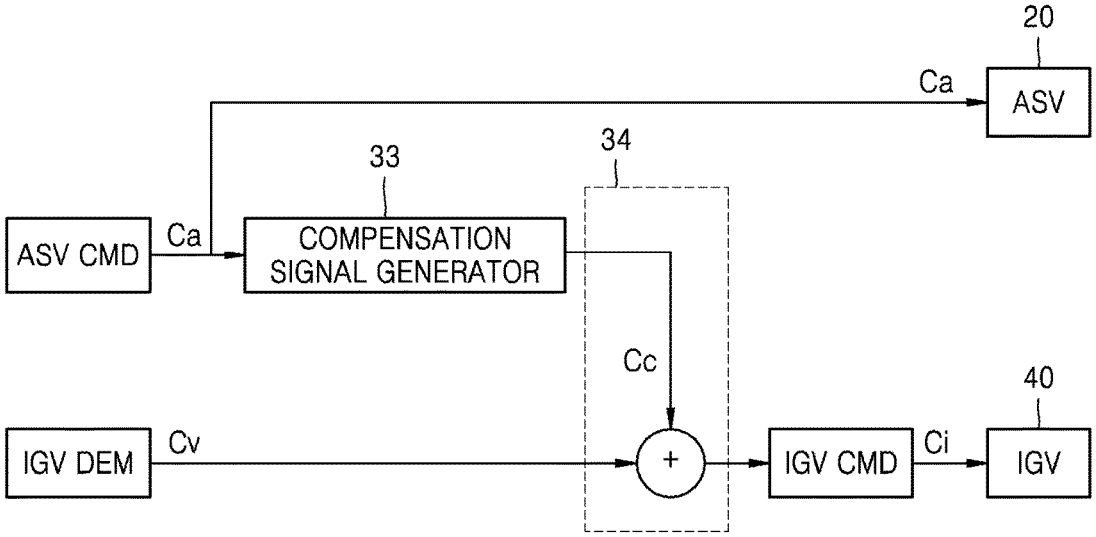
FIG. 4 is a schematic block diagram of flow of a control signal in the compressor control system of FIG. 3.

FIG. 4 is a schematic block diagram of flow of a control signal in the compressor control system of FIG. 3.

Referring to FIGS. 3 and 4, the ASV controller 31 generates the first signal Ca and transmits the first signal Ca to the ASV driver 21. Also, the ASV controller 31 transmits the first signal Ca to the compensation signal generator 33.

The compensation signal generator 33 generates the pressure compensation signal Cc by using the received first signal Ca and a change in the pressure at the outlet 12 of the compressor 10. When an opening range of the ASV 20 is changed by the first signal Ca, a flow rate of fluid varies and thus pressure at the outlet 12 of the compressor 10 is changed. The compensation signal generator 33 generates the pressure compensation signal Cc for controlling the opening range of the IGV 40 by compensating for the change in the pressure at the outlet 12 of the compressor 10 due to the first signal Ca. In other words, the pressure compensation signal Cc is a signal that controls the opening range of the IGV 40 to reduce the change in the pressure at the outlet 12 of the compressor 10 that is caused by the first signal Ca.

The compensation signal generator 33 may calculate a compensation signal by using an expression of a relation between the change in the opening range of the ASV 20 and the pressure at the outlet 12 of the compressor 10, and an expression of a relation between the change in the opening range of the IGV 40 and the pressure at the outlet 12 of the compressor 10. The expressions of a relation may be eigen equations of the ASV 20 and the IGV 40.

Also, the compensation signal generator 33 may calculate the pressure compensation signal Cc from stored data. A data storing unit (not shown) stores data about the change in the pressure at the outlet 12 of the compressor 10 according to the change in the opening range of the ASV 20, and data about the change in the pressure at the outlet 12 of the compressor 10 according to the change in the opening range of the IGV 40. The compensation signal generator 33 may calculate the pressure compensation signal Cc to reduce the change in the pressure at the outlet 12 of the compressor 10 by using the data stored in the data storing unit.

The IGV controller 32 generates the vane control signal Cv and transmits the vane control signal Cv to the operator 34. The operator 34 may generate the second signal Ci by combining the vane control signal Cv with the pressure compensation signal Cc.

As the pressure compensation signal Cc is added to the second signal Ci, the pressure change according to the change in the opening range of the ASV 20 may be compensated for in advance. The pressure at the outlet 12 of the compressor 10 may be controlled by the opening range of the IGV 40 without being affected by the opening range of the ASV 20. In other words, the ASV controller 31 and the IGV controller 32 may operate as being decoupled from each other.

Figure 5A:
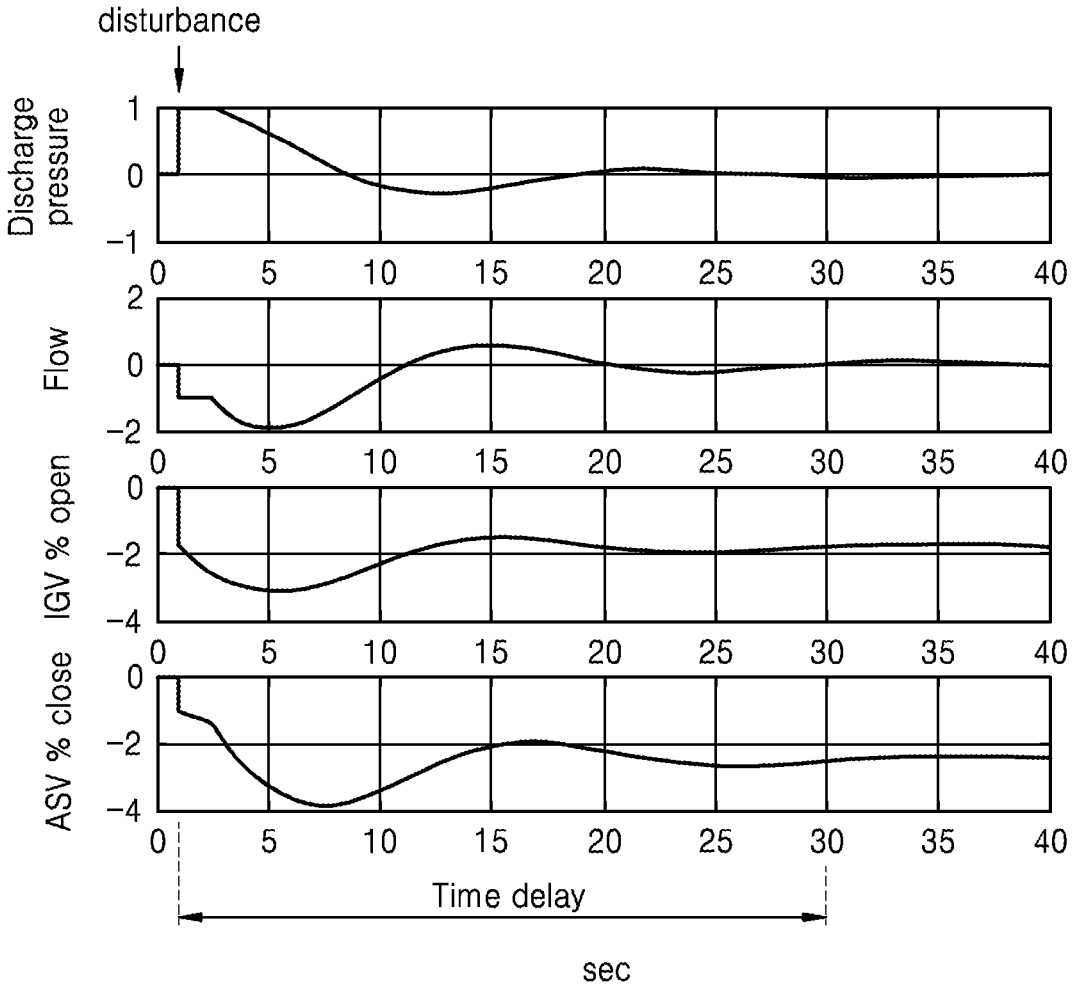
FIGS. 5A and 5B are graphs showing an example of an operation of a compressor control system according to a related art, which is varied by disturbance.
Figure 5B:
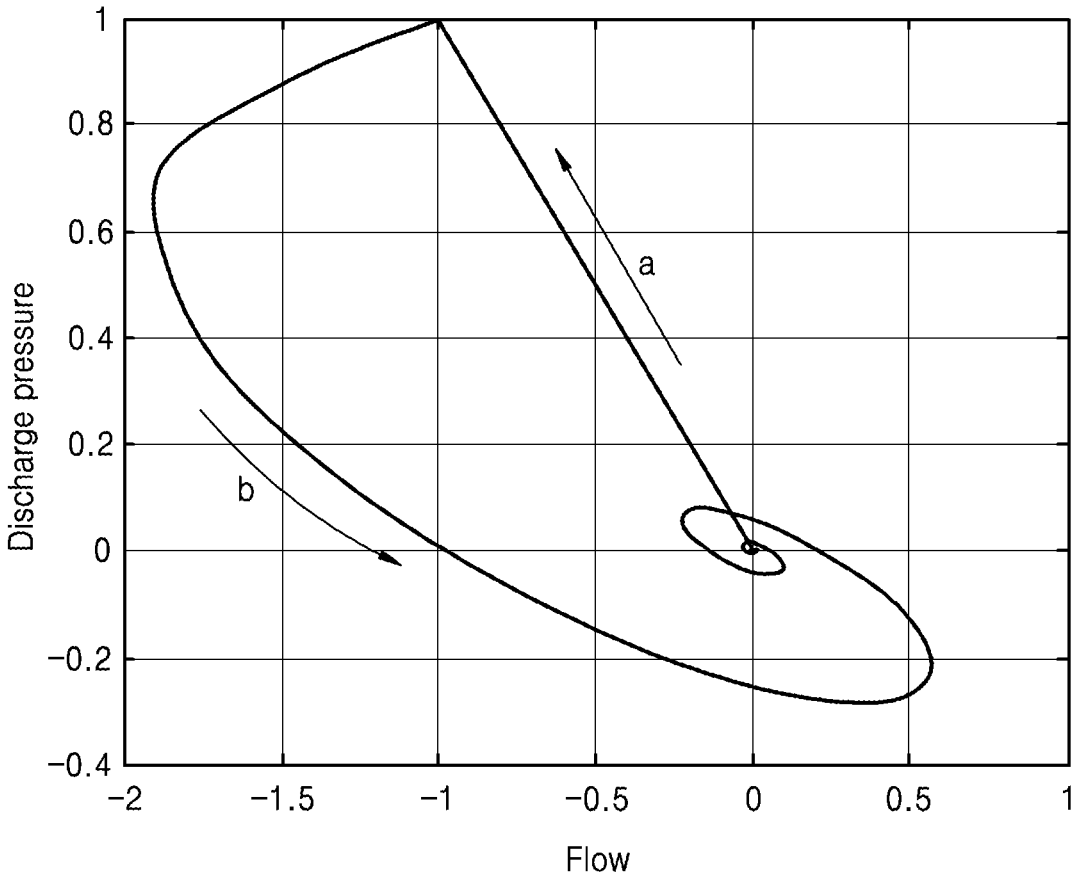
Figure 6A:
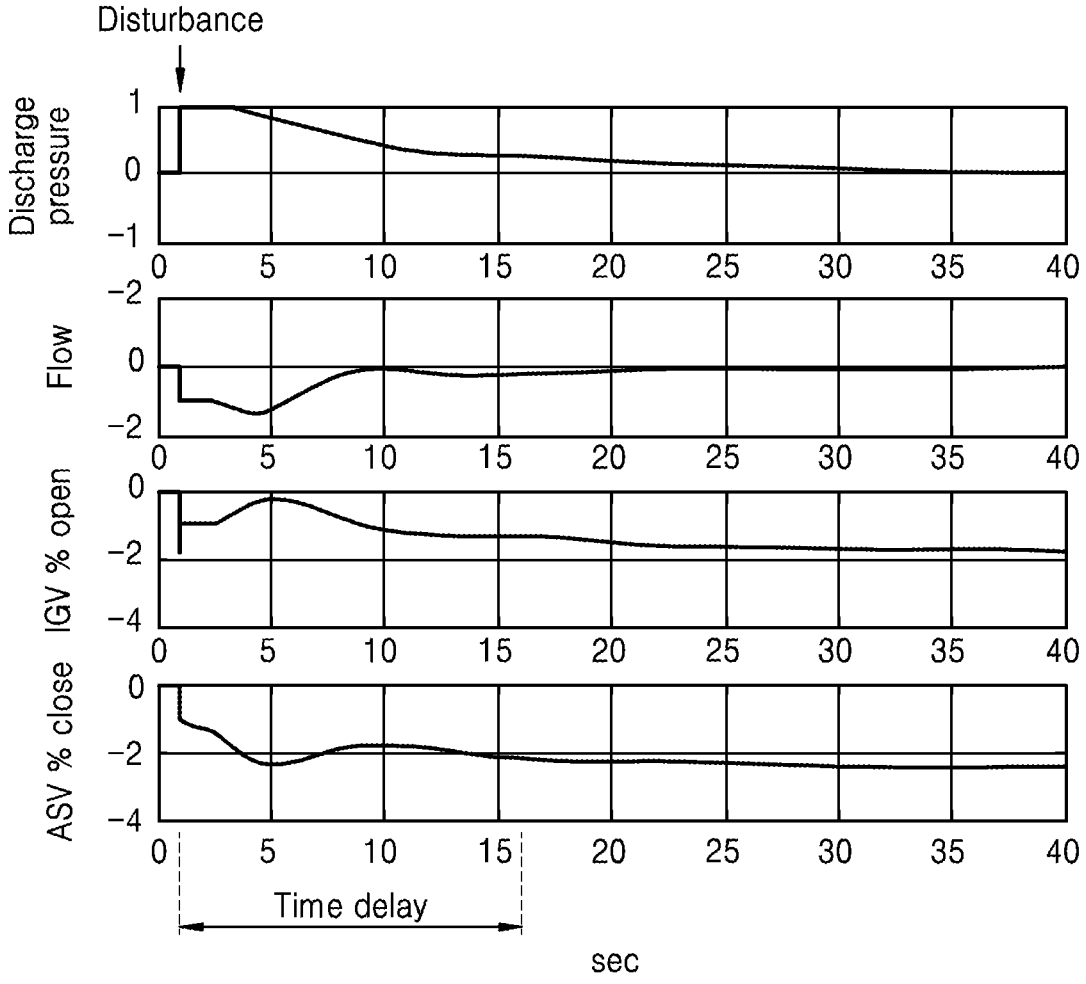
FIGS. 6A and 6B are graphs showing an example of an operation of the compressor control system of FIG. 3, which is varied by disturbance.
Figure 6B:
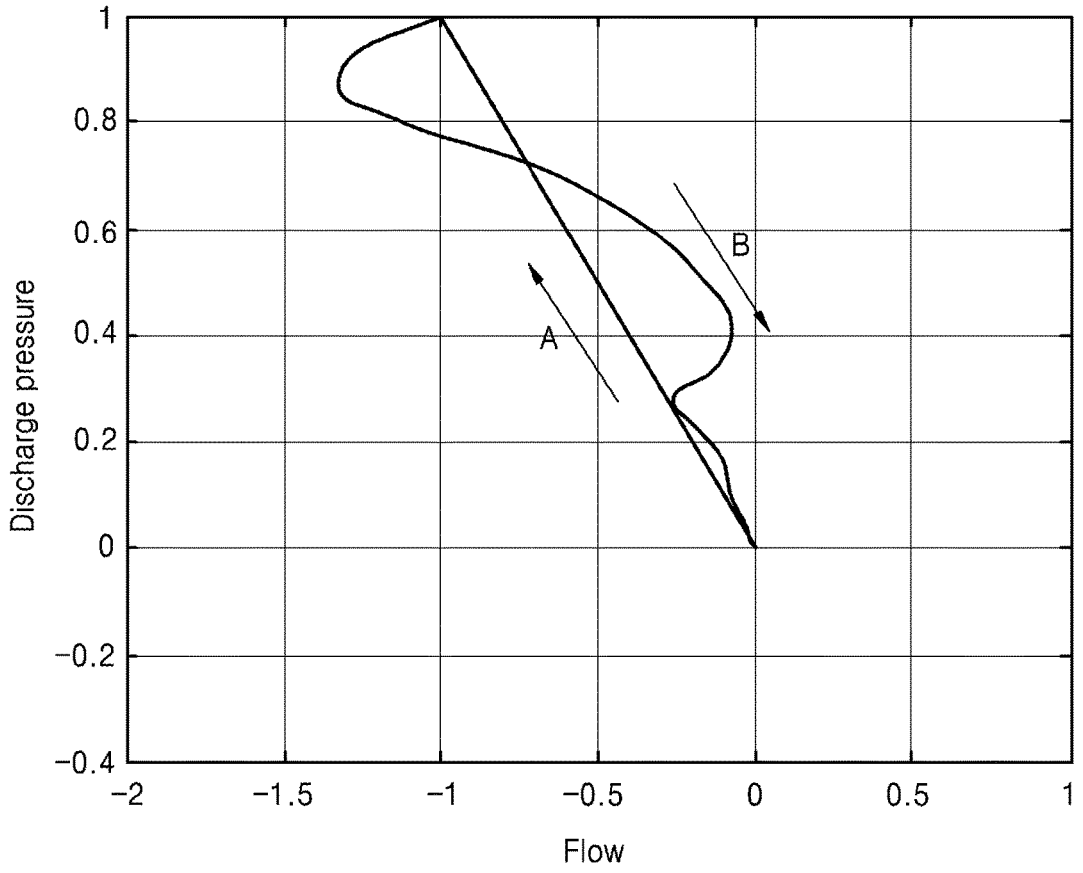

FIGS. 5A and 5B are graphs showing an example of an operation of a compressor control system according to a related art, which is varied by disturbance;

FIGS. 6A and 6B are graphs showing an example of an operation of the compressor control system of FIG. 3, which is varied by disturbance.

In the compressor control system according to the related art using both an IGV and an ASV, although the ejection pressure of a compressor may be controlled by the IGV, a flow rate (or a current signal for controlling a flow rate) is affected according to the operation of the IGV. Also, although the ASV may control the compressor by using a flow rate (or a current signal for controlling a flow rate), pressure is affected according to the operation of the ASV. Thus, since the operations of the two valves of the IGV and the ASV interfere with each other in a surge area of the compressor, the control of the compressor is difficult.

Referring to FIGS. 5A and 5B, when disturbance is generated in a compressor control system in a normal state and pressure at an outlet of a compressor increases, an opening range of an IGV decreases. Also, to prevent generation of surge, a flow rate passing through the compressor is decreased by increasing the opening range of an ASV.

A time delay is generated until the compressor control system resumes the normal state. In FIG. 5A, a time delay of about 30 seconds is generated. The time delay is generated by disturbance. Also, a change in the opening ranges of the inlet guide vane and the anti-surge valve by the disturbance act as a new disturbance so that the time delay is extended.

The flow rate and the pressure are rapidly changed due to the generation of disturbance. As illustrated in FIG. 5B, when disturbance "a" is generated, a pressure change is generated to resume a normal state "b", and a flow rate is changed much.

Referring to FIGS. 6A and 6B, when disturbance is generated in a compressor control system in a normal state and thus pressure at the outlet 12 of the compressor 10 increases, a surge phenomenon may be generated. To prevent surge, the ASV controller 31 transmits the first signal Ca to increase the opening range of the ASV 20 and thus the flow rate at the outlet 12 of the compressor 10 is decreased. Also, the IGV controller 32 decreases the opening rate of the IGV 40 to reduce the pressure at the outlet 12 of the compressor 10.

Since the rapid change in the opening range of the ASV 20 changes the pressure at the outlet 12 of the compressor 10, the change may act as a disturbance to the compressor control system. However, the pressure compensation signal Cc may compensate for the change in the pressure at the outlet 12 of the compressor 10, which is generated due to the change in the opening range of the ASV 20, by controlling the opening range of the IGV 40 in advance.

In other words, the compensation signal generator 33 may generate the second signal Ci by adding the pressure compensation signal Cc to the vane control signal Cv, thereby reducing the change in the pressure at the outlet 12 of the compressor 10 generated due to the change in the opening range of the ASV 20. Since the second signal Ci already compensates for the pressure change of the ASV 20, the controller 30 may control the pressure with only the second signal Ci.

The size of an absolute value of the second signal Ci may be smaller than that of an absolute value of the vane control signal Cv. The pressure compensation signal Cc may have a sign different from the vane control signal Cv. While the pressure compensation signal Cc prevents the rapid change in the opening range due to the second signal Ci, the signs of the pressure compensation signal Cc and the vane control signal Cv are different from each other.

Accordingly, the size of the absolute value of the second signal Ci may be smaller than that of the absolute value of the vane control signal Cv. Since the size of the absolute value of the second signal Ci decreases, even when the opening range of the IGV 40 changes, the compressor control system may be less affected. The pressure compensation signal Cc may reduce disturbance generated in the compressor control system due to the rapid pressure change.

In an IGV % OPEN graph of FIG. 6A, when disturbance is generated, the opening range of IGV % OPEN is about (−2) by the vane control signal Cv, and the second signal is changed to about (−1) by the pressure compensation signal Cc. Since the opening ranges of the IGV 40 and the ASV 20 are not rapidly changed, the time delay until the compressor control system returns to the normal state is reduced. In FIG. 6A, when disturbance is generated, a time delay of about 15 seconds is generated.

Even when disturbance "A" is generated, as illustrated in FIG. 6B, the pressure and the flow rate are not changed much while the compressor control system returns to a normal state "B", so that the compressor control system may quickly return to the normal state "B".

In response to the pressure compensation signal Cc, the flow rate of the compressor 10 is controlled by the first signal Ca of the ASV controller 31 and the pressure of the compressor 10 is controlled by the second signal Ci input to the IGV driver 41.

According to the first embodiment configured as above, the mutual influence of the ASV 20 and the IGV 40 is reduced so that a compressor may stably operate. In other words, since the amount of closure of the IGV 40 is compensated for by using the first signal Ca for the control of the ASV 20, the amount of closure of the IGV 40 is reduced during the operation of the ASV 20, so that the stability of an anti-surge control function may be improved.

Since the rapid change in the opening range of the IGV 40 may be reduced by adding the pressure compensation signal Cc considering the change in the pressure at the outlet 12 of the compressor 10 by the opening range of the ASV 20 (first signal indicating a degree of opening) to the vane control signal Cv of the IGV 40, the IGV 40 may operate in the form of assisting the anti-surge operation of the ASV 20.

In other words, when movement of the IGV 40 is fast, the pressure compensation signal Cc decreases the size of the absolute value of the vane control signal Cv to prevent a rapid change in the opening range of the IGV 40 and thus pressure hunting is not generated, and the compressor control system may quickly escape the surge area.

Figure 7:
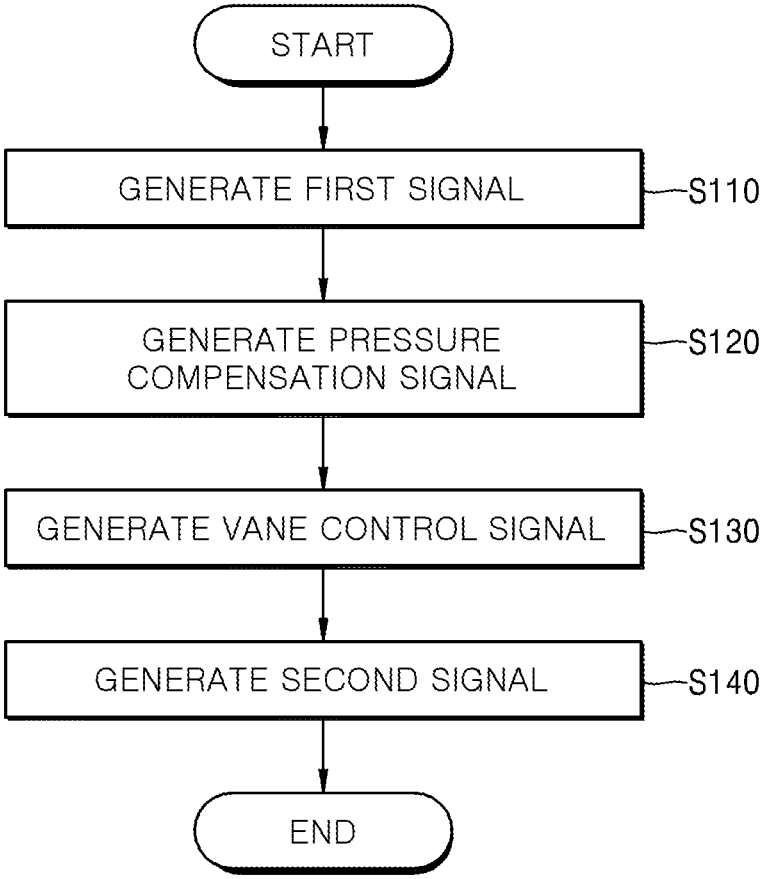
FIG. 7 is a flowchart schematically showing a method of controlling a compressor, according to another exemplary embodiment.

FIG. 7 is a flowchart schematically showing a method of controlling a compressor, according to another exemplary embodiment.

A method of controlling a compressor, according to the embodiment exemplified by FIG. 7, includes generating a first signal to operate an anti-surge valve that is arranged on a line connecting an input and an outlet of a compressor for compressing fluid and prevents backflow in the compressor (S110), generating a pressure compensation signal to control an inlet guide vane to compensate for a change in the pressure at the output of the compressor according to the first signal (S120), generating a vane control signal to control the inlet guide vane that is arranged at the inlet of the compressor and controls an opening area of the inlet (S130), and generating a second signal to operate the inlet guide vane by combining the pressure compensation signal with the vane control signal (S140).

According to the above-described method of controlling a compressor, since the inlet guide vane is controlled to compensate for the pressure change at the outlet of the compressor due to a change in the opening range of an anti-surge valve, a coupling phenomenon that may be generated between the control operations of the two elements of the inlet guide vane and the anti-surge valve is removed and thus the compressor may be stably controlled.

As described above, in the compressor control system and method of controlling a compressor, according to the present inventive concept, since the influence of the anti-surge valve of the control operations of the two elements of the inlet guide vane and the anti-surge valve is dominantly controlled, a coupling phenomenon that may be generated between the control operations of the two elements of the inlet guide vane and the anti-surge valve is removed and thus the compressor may be stably controlled.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A compressor control system comprising:

a compressor configured to compress a fluid;

an anti-surge valve configured to prevent backflow in the compressor, the anti-surge valve being arranged on a bypass line connecting an inlet and an outlet of the compressor and operated by a first signal;

an inlet guide vane configured to control an opening area of the inlet, the inlet guide vane being arranged at the inlet and operated by a second signal; and a controller connected to the anti-surge valve and the inlet guide vane, the controller configured to generate:

the first signal to control the anti-surge valve, a vane control signal to control the inlet guide vane, a pressure compensation signal to control the inlet guide vane to compensate for a change in pressure at the outlet of the compressor according to the first signal, and the second signal by combining the pressure compensation signal with the vane control signal.

2. The compressor control system of claim 1, wherein a size of an absolute value of the second signal is smaller than a size of an absolute value of the vane control signal.

3. The compressor control system of claim 1, wherein the controller is configured to calculate the pressure compensation signal based on a relation between change in a degree of closure of the anti-surge valve and pressure at the outlet of the compressor, and based on a relation between change in the opening area of the inlet controlled by the inlet guide vane and pressure at the outlet of the compressor.

4. A method of controlling a compressor, the method comprising:

generating a first signal to operate an anti-surge valve that is arranged on a line connecting an inlet and an outlet of a compressor for compressing fluid and prevents backflow in the compressor;

generating a pressure compensation signal to control an inlet guide vane to compensate for a change in pressure at the outlet of the compressor according to the first signal;

generating a vane control signal to control the inlet guide vane that is arranged at the inlet of the compressor and controls an opening area of the inlet; and generating a second signal to operate the inlet guide vane by combining the pressure compensation signal with the vane control signal.

5. The method of claim 4, wherein, in the generating of the second signal, the pressure compensation signal is combined with the vane control signal and a size of an absolute value of the second signal is smaller than a size of an absolute value of the vane control signal.

6. The method of claim 4, wherein the pressure compensation signal is generated based on a relation between change in a degree of closure of the anti-surge valve and pressure at the outlet of the compressor, and based on a relation between change in the opening area of the inlet controlled by the inlet guide vane and pressure at the outlet of the compressor.

* * * * *